United States Patent [19]

Bridges et al.

[11] Patent Number: 4,570,143

[45] Date of Patent: Feb. 11, 1986

[54] THERMALLY ACTUATED VARIABLE-RATING CIRCUIT BREAKER HAVING SELECTIVELY CONNECTABLE HEATER ELEMENTS

[75] Inventors: Robert B. Bridges, Elm Grove; John R. Brubaker, Milwaukee; Jerome K. Hastings, Sussex, all of Wis.

[73] Assignee: Eaton Corporation, Cleveland, Ohio

[21] Appl. No.: 648,204

[22] Filed: Sep. 7, 1984

[51] Int. Cl.[4] ..... H01H 71/16; H01H 61/02

[52] U.S. Cl. ..... 337/75; 337/77; 337/104

[58] Field of Search ..... 337/68, 75, 77, 81, 337/82, 85, 88, 102, 103, 104, 113, 35, 38, 40, 41, 45, 47, 257, 258; 335/43, 45

[56] References Cited

U.S. PATENT DOCUMENTS 2,416,169 2/1947 Freese ..... 337/75

*Primary Examiner*—Harold Broome

*Attorney, Agent, or Firm*—C. H. Grace; L. G. Vande Zande

[57] ABSTRACT

A pair of heaters (16,18) are mounted within a breaker housing (2) in spaced relation to a temperature responsive actuator element (30) for indirectly heating that element in response to current flow in the heaters. Each heater is provided with a wiring terminal member (6,8) for selectively individually connecting one or the other heater in circuit with a branch circuit to be protected. One heater (16) is selected to generate greater amounts of heat than the other heater (18) when subjected to the same current levels. The heaters are individually selectively connected in the branch circuit to be protected whereby the heater (16) producing greater amounts of heat may be utilized in a lower ampere rate application and the heater (18) producing lesser amounts of heat may be utilized in a higher ampere rated application, thereby to selectively permit predetermined current flows in the branch circuit for heating the actuator element (30) to its predetermined temperture to effect separation of the circuit breakers contacts (26).

3 Claims, 1 Drawing Figure

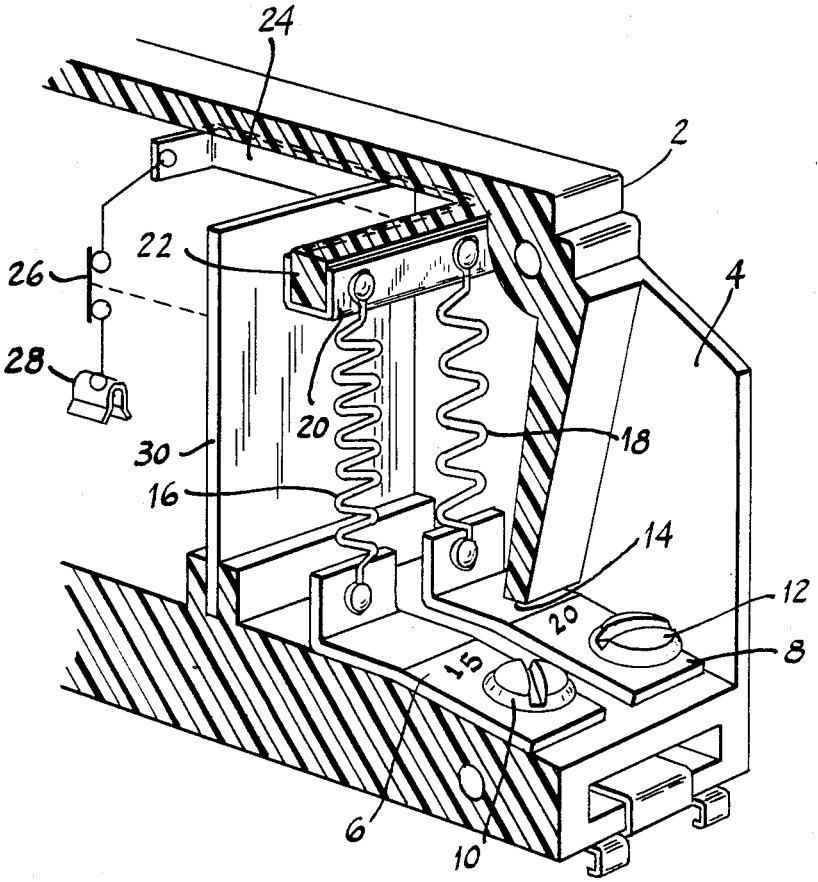
24
2
22
26
4
28
20
18
30
16
14
12
20
8
15
6
10

THERMALLY ACTUATED VARIABLE-RATING CIRCUIT BREAKER HAVING SELECTIVELY CONNECTABLE HEATER ELEMENTS

CROSS-REFERENCE TO RELATED APPLICATIONS

This invention is related to the disclosures in co-pending applications Ser. Nos. 648,205 filed Sept. 7, 1984 by Bruce Beihoff et al entitled Thermally Actuated Variable-Rating Circuit Breaker Having Adjustable Thermal Barrier, and Ser. No. 648,203 filed Sept. 7,1984 by Robert B. Bridges et al entitled Thermally Actuated Variable-Rating Circuit Breaker Having Adjustable Heat Sink Means, assigned to the assignee of this invention.

BACKGROUND OF THE INVENTION

This invention relates to molded case circuit breakers of the residential and commercial frame type. More particularly, the invention relates to circuit breakers of the aforementioned type which are thermally actuated to cause the separation of the circuit breaker contacts.

Residential and commercial frame circuit breakers are utilized in panelboards and load centers for protecting branch lighting and appliance circuits. Circuit breakers of this type are available in various ampere ratings, the most common being 15 and 20 ampere rated breakers. Commonly, breakers of the two ratings are structurally the same but utilize thermal trip elements having different operating characteristics. Accordingly, the manufacturer provides and the distributor stocks two distinct breakers to accommodate both the 15 amp and 20 amp ratings, which results in a substantial inventory for both.

SUMMARY OF THE INVENTION

This invention provides a circuit breaker which may be selectively utilized for either of two distinct ampere ratings as desired. The breaker comprises a pair of current responsive heater elements which are selectively connected in the branch circuit to be protected for indirectly heating a thermally responsive contact actuator. The invention and its advantages will be more clearly understood when reading the following description and claims in conjunction with the drawing.

BRIEF DESCRIPTION OF THE DRAWING

A single FIGURE of the drawing shows a fragmentary portion of a circuit breaker partially in perspective and partially in schematic, constructed in accordance with this invention.

DESCRIPTION OF THE PREFERRED EMBODIMENT

This invention is embodied in a narrow width molded case residential and commercial frame circuit breaker of the type disclosed in M. F. Koenig et al, U.S. Pat. No. 3,081,386 issued March 12, 1963. A molded housing 2 has a pocket 4 at one end thereof in which is disposed a pair of wiring terminal straps 6 and 8 which have terminal screws 10 and 12, respectively, threadably attached thereto for connection of a wire from a branch circuit which is to be protected. The terminal straps 6 and 8 project interiorly of housing 2 through a slot 14 provided in an endwall of the housing. A pair of heaters 16 and 18 are electrically connected to the interior ends of terminal straps 6 and 8, respectively. The opposite ends of heaters 16 and 18 are electrically connected to a U-shaped conductor member 20 which is disposed over a depending rib 22 formed on the interior of the upper wall of housing 2. Conductor 20 has an integrally formed connector strip 24 which extends along an interior sidewall of the housing 2 and is electrically connected to one side of separable contacts 26 of the circuit breaker. The opposite side of circuit breaker contacts 26 is connected to a terminal member 28 of the circuit breaker which may be of the plug-in or bolt-on type commonly known in circuit breaker art.

A temperature responsive actuator element 30 is mounted within the breaker housing 2 in spaced relation to the heaters 16 and 18. The element 30 may be formed of a material which responds to a predetermined temperature by deflecting from its original position, such as a bi-metal material or a shape memory effect alloy material. In the embodiment depicted in the drawing, the upper end of the actuator element 30 is arranged to deflect leftward to effect separation of contacts 26. The separation of the contacts may be directly effected by the actuator element 30 or may be effected through an intermediate trip mechanism well known in the circuit breaker art. The heater elements 16 and 18 indirectly heat the actuator element 30 to cause it to attain the required predetermined temperature for contact actuation.

According to this invention, it may be seen that heater element 16 contains a greater number of coils than does heater element 18. Accordingly, heater element 16 is chosen to generate a greater amount of heat at a given current level than will heater element 18. Thus, to utilize the circuit breaker of this invention in a 15 amp rated application, the wire of the branch circuit which is to be protected is connected to terminal strap 6. The other side of the branch circuit is connected to terminal 28. Current flow through terminal strap 6, heater 16, conductor 20, connector strap 24, contacts 26 and terminal 28 will cause heater 16 to generate a specific heating value. That value and the predetermined temperature for actuation of actuator 30 are chosen to permit the continuous operation of current values up to 15 amps. Current values in excess of this value will cause heater element 16 to generate adequate heat for raising the temperature of actuator 30 to the predetermined temperature, thereby to effect separation of contacts 26. If the circuit breaker is to be utilized in a 20 amp application, the wire from the branch circuit is connected to the terminal strap 8 whereby the circuit through the breaker will include heater element 18 instead of heater element 16. The increased current flow through the lower heating value heater 18 will permit the protected circuit to operate at a 20 amp current level without effecting separation of the breaker contacts. However, current levels above this value will cause the heater 18 to generate adequete heat for raising the temperature of actuator 30 to the predetermined temperature to effect separation of contacts 26.

The 15 and 20 amp current ratings described herein are exemplary only and are not intended to limit the scope of the invention. It is to be understood that the breaker of this invention is susceptible to various modifications without departing from the scope of the appended claims.

We claim:

1. A variable-rating circuit breaker comprising:

a single set of separable contacts;

first terminal means for connecting one side of said separable contacts in a circuit to be protected by said circuit breaker;

a single temerpature responsive actuator means for effecting separation of said contacts upon attaining a predetermined temperature;

a pair of heaters for individually generating respectively difficult heat values connected in circuit with an opposite side of said separable contacts; and second terminal means associated with each heater for selectively connecting a respective one of said heaters in said circuit for heating said actuator means to said predetermined temperature in response to a selected predetermined current value in said circuit.

2. The invention defined in claim 1 wherein said second terminal means comprises a pair of wiring terminals respectively connected to said pair of heaters, and a wire from said circuit is selectively attached to one of said wiring terminals.

3. The invention defined in claim 1 wherein one of said heaters has a greater heating value than the other, and a wire from said circuit is attached to said second terminal means associated with said one heater for protecting said circuit at a lower of two predetermined current values.

* * * * *